US009593910B1

(12) United States Patent
Fisher

(10) Patent No.: US 9,593,910 B1
(45) Date of Patent: Mar. 14, 2017

(54) FIREARM SIGHT TOOL

(71) Applicant: Danny Fisher, El Cajon, CA (US)

(72) Inventor: Danny Fisher, El Cajon, CA (US)

(73) Assignee: Danny Fisher, El Cajon, CA (US)

( * ) Notice: Subject to any disclaimer, the term of this patent is extended or adjusted under 35 U.S.C. 154(b) by 0 days.

(21) Appl. No.: 15/161,222

(22) Filed: May 21, 2016

(51) Int. Cl.

| | |
|---|---|
| ***F41G 1/54*** | (2006.01) |
| ***F41G 11/00*** | (2006.01) |
| ***F41G 1/02*** | (2006.01) |
| ***F41G 1/22*** | (2006.01) |

(52) U.S. Cl.
CPC ..... *F41G 1/545* (2013.01); *F41G 1/02* (2013.01); *F41G 1/22* (2013.01); *F41G 11/00* (2013.01); *F41G 11/003* (2013.01)

(58) Field of Classification Search
CPC ... F41G 1/54; F41G 1/545; F41G 1/16; F41G 3/323; F41G 3/32; F41A 29/00; F41A 35/00; F41C 27/00
USPC ..... 42/108
See application file for complete search history.

(56) References Cited

U.S. PATENT DOCUMENTS 2,599,839 A * 6/1952 Keifer, Jr. ..... F41G 1/26 254/98
5,202,524 A * 4/1993 Nechushtan ..... F41G 1/02 29/513
5,864,957 A * 2/1999 Small ..... F41G 1/54 42/111
9,464,870 B2 * 10/2016 Gomez ..... F41G 1/545
2011/0167702 A1 * 7/2011 Bietsch ..... F41G 1/545 42/90
2011/0252688 A1 * 10/2011 Bietsch ..... F41G 1/545 42/90
2013/0255128 A1 * 10/2013 Fisher ..... F41C 27/00 42/108
2014/0230304 A1 * 8/2014 Hillwig, Jr. ..... F41G 1/545 42/90
2015/0135500 A1 * 5/2015 Jorge Gomez ..... F41G 1/545 29/402.01
2016/0252323 A1 * 9/2016 Gomez ..... F41G 1/545 42/108

* cited by examiner

*Primary Examiner* — Derrick Morgan
(74) *Attorney, Agent, or Firm* — Kali Law Group, P.C.

(57) ABSTRACT

Firearm sight tools for removing and installing firearm sights are presented, the firearm sight tools including: a clamping assembly for clamping a firearm slide: a dovetail sight removal and installation assembly removably coupled with the clamping assembly for removing and installing a dovetail sight for the firearm slide; and a front sight staking assembly removably coupled with the clamping assembly for staking a front sight for the firearm slide. In some embodiments, the clamping assembly further includes: a pair of side plates for providing clamping surface, where the pair of side plates are substantially parallel with one another; a number of clamping bolts for providing a clamping force for the pair of side plates; and a cutout positioned along a top edge of each of the pair of side plates, the cutout provided for locating the dovetail sight removal and installation assembly.

15 Claims, 5 Drawing Sheets

FIREARM SIGHT TOOL

BACKGROUND

Currently there exist a variety of options for installing and removing firearm sights for firearms, but none of those options have the ability to both remove and install dovetail sights as well as stake front sights. While procedures for removing and installing firearm sights are relatively simple, they often require specialized tooling. In conventional solutions, specialized hand presses constructed to a specific brand of firearm have been provided for installing and removing manufacture specific sights. However, out-of-brand firearms may have structures that interfere with specialized tooling. As such, gun smiths may be required to alter nonspecific tools or use those nonspecific tools in a manner that may not produce consistent or desirable results. In addition, many conventional firearm sight tools may lack the ability to properly align firearm sights with the tool and may therefore damage or otherwise mar firearm surfaces inadvertently. As such, firearm sight tools are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, firearm sight tools for removing and installing firearm sights are presented, the firearm sight tools including: a clamping assembly for clamping a firearm slide: a dovetail sight removal and installation assembly removably coupled with the clamping assembly for removing and installing a dovetail sight for the firearm slide; and a front sight staking assembly removably coupled with the clamping assembly for staking a front sight for the firearm slide. In some embodiments, the clamping assembly further includes: a pair of side plates for providing clamping surface, where the pair of side plates are substantially parallel with one another; a number of clamping bolts for providing a clamping force for the pair of side plates; and a cutout positioned along a top edge of each of the pair of side plates, the cutout provided for locating the dovetail sight removal and installation assembly such that the dovetail sight removal and installation assembly may be mounted on either of the pair of side plates. In some embodiments, the dovetail sight removal and installation assembly includes: a pusher block; a number of mounting holes disposed along each end of the pusher block, the number of mounting holes configured for receiving a number of mounting bolts for mechanically and removably coupling the pusher block with either of the pair of side plates proximate with the cutout; a pusher bolt threadingly engaged with the pusher block; a pusher bearing disposed along an end of and in mechanical communication with the pusher bolt; and a pusher rod slidingly engaged with the pusher block along an axis of the pusher bolt and in mechanical communication with the pusher bearing. In some embodiments, the dovetail sight removal and installation assembly further includes a protective insert for placing between the pusher rod and the dovetail sight such that the dovetail sight is protected from marring when being installed or removed. In some embodiments, the clamping assembly further includes: a pair of side plates for providing clamping surface, where the pair of side plates are substantially parallel with one another; a number of clamping bolts for providing a clamping force for the pair of side plates; a front pivot point disposed along a lower front portion of the pair of side plates for receiving a pivot rod of the front sight staking assembly; and a pair of top mounting holes for removably receiving a sight stop plate of the front sight staking assembly. In some embodiments, the front sight staking assembly includes: a staking lever removably and pivotally coupled with the clamping assembly along one of the number of clamping bolts, the staking lever providing a support disposed along an inner chamber of the firearm slide; a staking pin disposed along a top surface of the staking lever for staking the front sight; a staking pivot rod engaged with the front pivot point; a staking bolt threadingly engaged with the staking pivot rod for raising the staking lever; a front sight stop plate removably coupled with the clamping assembly along the pair of top mounting holes; and a front sight stop threadingly engaged with the front sight stop plate for securing the front sight from moving during a staking operation. In some embodiments, the staking lever further includes: an elongated pivot hole for providing staking lever adjustment in a forward and backward direction; a front adjustment screw for adjusting the staking lever in the forward and backward direction; and a rear adjustment screw for adjusting the staking lever in the forward and backward direction. In some embodiments, the staking lever further includes: a pair of staking lever spacers disposed along the one of the number of clamping bolts on either side of the staking lever. In some embodiments, the staking lever further includes: a protective disc disposed along a contact surface of the front sight stop to provide a non-marring surface for the front sight during the staking operation. In some embodiments, the clamping assembly further includes a pair of protective layers disposed along an inner surface of the pair of side plates to provide a non-marring surface when clamping a firearm slide. In some embodiments, the clamping assembly further includes: a number of protective sleeves disposed along the number of clamping bolts to provide a protective surface for the number of clamping bolts.

In other embodiments, methods for removing and installing firearm sights are provided including: receiving a firearm slide; providing a firearm sight tool, the firearm sight tool including, a clamping assembly for clamping a firearm slide, a dovetail sight removal and installation assembly removably coupled with the clamping assembly for removing and installing a dovetail sight for the firearm slide, and a front sight staking assembly removably coupled with the clamping assembly for staking a front sight for the firearm slide; clamping the firearm slide in the firearm sight tool; and installing a sight on the firearm slide. In some embodiments, the clamping assembly further includes: a pair of side plates for providing clamping surface, where the pair of side plates are substantially parallel with one another, a number of clamping bolts for providing a clamping force for the pair of side plates, and a cutout positioned along a top edge of each of the pair of side plates, the cutout provided for locating the dovetail sight removal and installation assembly such that the dovetail sight removal and installation assembly may be mounted on either of the pair of side plates, where the sight is a dovetail sight, and where the method further includes: aligning the dovetail sight with the dovetail sight removal and installation assembly, the dovetail sight removal and installation assembly including, a pusher block, a number of mounting holes disposed along each end of the pusher block, the number of mounting holes configured for receiving a number of mounting bolts for mechanically and removably coupling the pusher block with either of the pair of side plates proximate with the cutout, a pusher bolt threadingly engaged with the pusher block, a pusher bearing disposed along an end of and in mechanical communication with the pusher bolt, and a pusher rod slidingly engaged with the pusher block along an axis of the pusher bolt and in mechanical communication with the pusher bearing; positioning the dovetail sight on the firearm slide; and engaging the firearm sight tool to install the dovetail sight. In some embodiments, the clamping assembly further includes: a pair of side plates for providing clamping surface, where the pair of side plates are substantially parallel with one another, a number of clamping bolts for providing a clamping force for the pair of side plates, a front pivot point disposed along a lower front portion of the pair of side plates for receiving a pivot rod of the front sight staking assembly, and a pair of top mounting holes for removably receiving a sight stop plate of the front sight staking assembly, where the sight is a front sight, and where the method further includes: aligning the front sight with the front sight staking assembly, the front sight staking assembly including, a staking lever removably and pivotally coupled with the clamping assembly along one of the number of clamping bolts, the staking lever providing a support disposed along an inner chamber of the firearm slide, a staking pin disposed along a top surface of the staking lever for staking the front sight, a staking pivot rod engaged with the front pivot point, a staking bolt threadingly engaged with the staking pivot rod for raising the staking lever, a front sight stop plate removably coupled with the clamping assembly along the pair of top mounting holes, and a front sight stop threadingly engaged with the front sight stop plate for securing the front sight from moving during a staking operation; positioning the front sight on the firearm slide; and engaging the firearm sight tool to stake the front sight.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
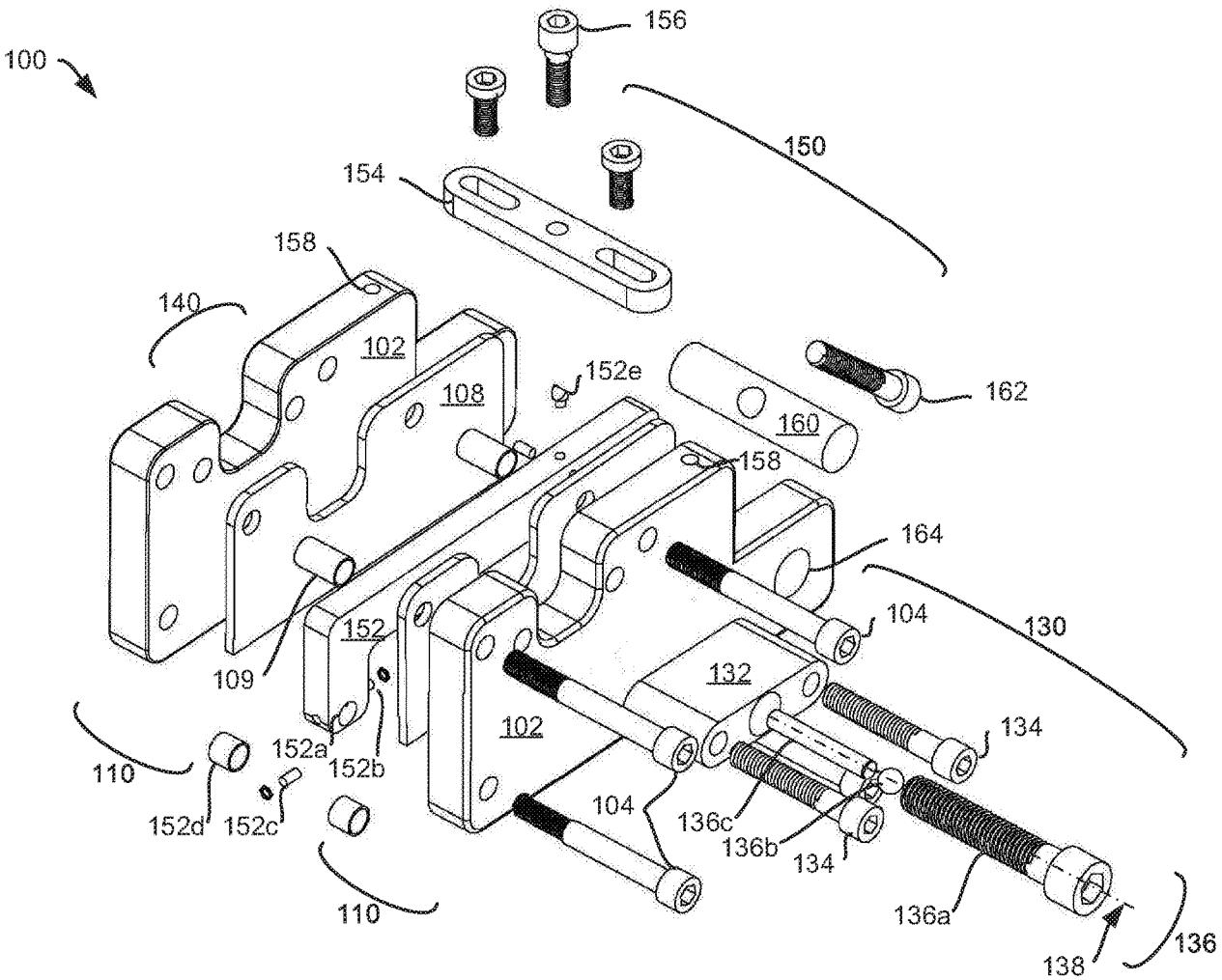
FIG. 1 is an illustrative exploded view representation of a firearm sight tool in accordance with embodiments of the present invention.

FIG. 1 is an illustrative exploded view representation of a firearm sight tool 100 in accordance with embodiments of the present invention. This exploded representation is provided for clarity in understanding structural and functional relationships between mechanical assemblies and components. In general, as illustrated, firearm sight tool 100 includes clamping assembly 110 for clamping a firearm slide; dovetail sight removal and installation assembly 130 that may be removably coupled with clamping assembly 110 for removing and installing a dovetail sight for a firearm slide; and front sight staking assembly 150 that may be removably coupled with clamping assembly 110 for staking a front sight for the firearm slide. In particular, clamping assembly 110 may include: side plates 102 for providing clamping surface. In operation, the side plates may be maintained in a parallel or substantially parallel orientation with respect to one another. Parallelism may be maintained by clamping bolts 104, which also may be utilized to exert a clamping force for the side plates on a firearm slide. It may be appreciated that a user of firearm sight tool embodiments may not wish to mar or damage a firearm slide while installing or removing sights. As such, protective layer 108 may be disposed along an inner surface of either or both side plates 102 to provide a non-marring surface when clamping a firearm slide. In addition, a number of protective sleeves 109 may be disposed along clamping bolts 104 to provide a protective surface for the clamping bolts. In embodiments, protective layers and protective sleeves may be manufactured from a flexible of semi-flexible polymeric material without limitation.

Further illustrated is dovetail sight removal and installation assembly 130 which includes pusher block 132. Pusher block 132 includes mounting holes disposed along each end of the pusher block. As may be seen, the mounting holes may receive mounting bolts 134 for mechanically and removably coupling the pusher block with either of side plates 102 proximate with cutout 140. As illustrated, cutout 140 may be positioned along a top edge of side plate 102. The cutout is provided for accessing a sight location on a firearm slide and for locating dovetail sight removal and installation assembly 130. It may be seen that dovetail sight removal and installation assembly 130 may be mounted on either of side plates 102. In operation, a dovetail sight may be removed or installed by pushing the dovetail sight into position by pusher 136, which includes at least three components namely: pusher bolt 136*a* threadingly engaged with pusher block 132; pusher bearing 136*b* disposed along an end of and in mechanical communication with pusher bolt 136*a*; and pusher rod 136*c* slidingly engaged with pusher block 132 along axis 138 of pusher bolt 136*a* and in mechanical communication with pusher bearing 136*b*. As above, it may be appreciated that a user of firearm sight tool embodiments may not wish to mar or damage a dovetail sight during removal or installation. As such, in embodiments a protective insert for placing between pusher rod 136*c* and a dovetail sight such that the dovetail sight is protected from marring when being installed or removed may be provided. Although the protective insert is not illustrated, one skilled in the art will recognize the structure and function of such a protective insert. In embodiments, protective inserts may be manufactured from a flexible of semi-flexible polymeric material without limitation.

Further illustrated is front sight staking assembly 150 which includes staking lever 152 that may be removably and pivotally coupled with clamping assembly 110 along clamping bolt 104. In operation, staking lever 152 may provide support for staking pin 152*e* disposed along a top surface of staking lever 152 for staking a front sight and may be disposed along an inner chamber of a firearm slide. Staking lever 152 may further include: elongated pivot hole 152*a* for providing staking lever adjustment in a forward and backward direction. Adjustment may be made and fixed by mechanical adjustment of front adjustment screw 152*b* and rear adjustment screw 152*c* which may be utilized for adjusting staking lever 152 in a forward and backward direction. In addition, staking lever spacers 152*d* may be utilized to correctly position staking lever 152 between side plates 102. In embodiments, front sight staking assembly 150 further includes staking pivot rod 160 engaged with a front pivot point 164 which pivot point may be disposed along a lower front portion of side plates 102. As illustrated, staking bolt 162 may be threadingly engaged with staking pivot rod 160 for raising and supporting staking lever 152. Further illustrated, front sight staking assembly 150 includes front sight stop plate 154 removably coupled with clamping assembly 110 along mounting holes 158. Front sight stop 156 may be threadingly engaged with front sight stop plate 154 and may be utilized for securing a front sight from moving during a staking operation. As above, it may be appreciated that a user of firearm sight tool embodiments may not wish to mar or damage a front sight during a staking operation. As such, in embodiments a protective disc for placing between front sight stop 156 and a front sight such that the front sight is protected from marring when being staked may be provided. Although the protective disc is not illustrated, one skilled in the art will recognize the structure and function of such a protective disc. In embodiments, protective discs may be manufactured from a flexible of semi-flexible polymeric material without limitation. Detailed operational aspects of embodiments disclosed herein will be discussed in further detail below for FIGS. 2-7.

Figure 3:
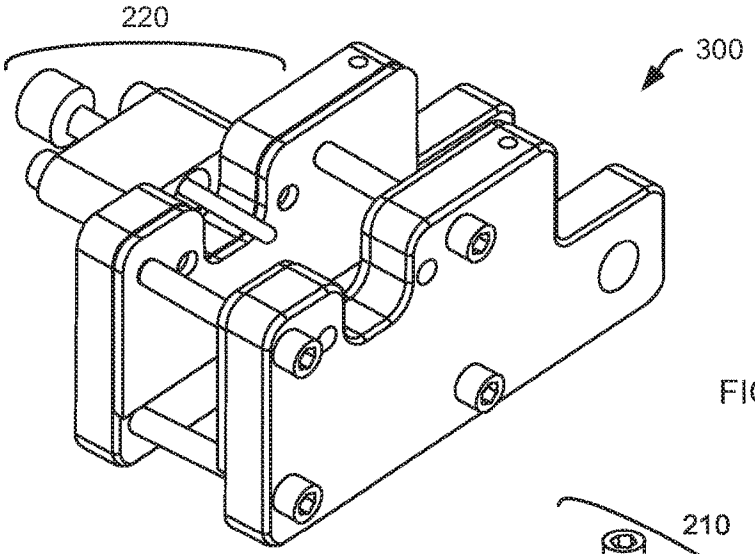
FIG. 3 is an illustrative representation of a firearm sight tool with dovetail sight removal and installation assembly in accordance with embodiments of the present invention.
Figure 4:
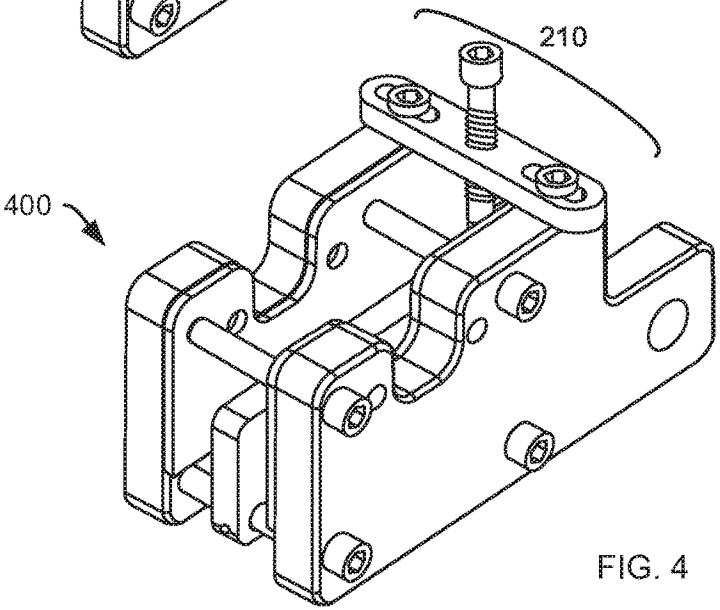
FIG. 4 is an illustrative representation of a firearm sight tool with front staking assembly in accordance with embodiments of the present invention.
Figure 2:
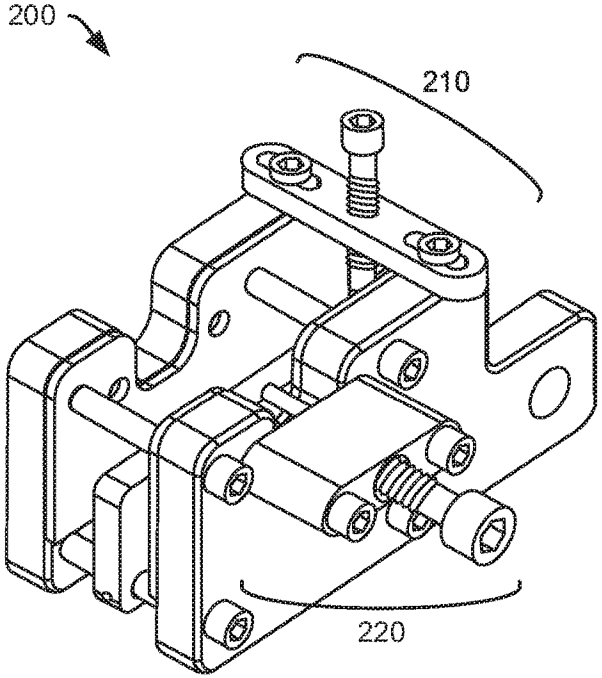
FIG. 2 is an illustrative representation of a firearm sight tool with front staking assembly and dovetail sight removal and installation assembly in accordance with embodiments of the present invention.

FIGS. 2-4 represent various configurations in which embodiments of the present invention may be utilized. These variations are for illustrative purposes only and should not be construed as limiting. As such, FIG. 2 is an illustrative representation of firearm sight tool 200 with front staking assembly 210 and dovetail sight removal and installation assembly 220 in accordance with embodiments of the present invention. FIG. 3 is an illustrative representation of firearm sight tool 300 with dovetail sight removal and installation assembly 220 in accordance with embodiments of the present invention. As may be compared between FIG. 2 and FIG. 3, dovetail sight removal and installation assembly 220 may be placed on either side of the firearm sight tool 200 and 300. In some examples, dovetail sights may be installed and removed from one side only or may move in only a single direction. It may be therefore useful to be able to switch sides of the dovetail sight removal and installation assembly to accommodate such dovetail sights. FIG. 4 is an illustrative representation of firearm sight tool 400 with front staking assembly 210 in accordance with embodiments of the present invention.

Figure 6:
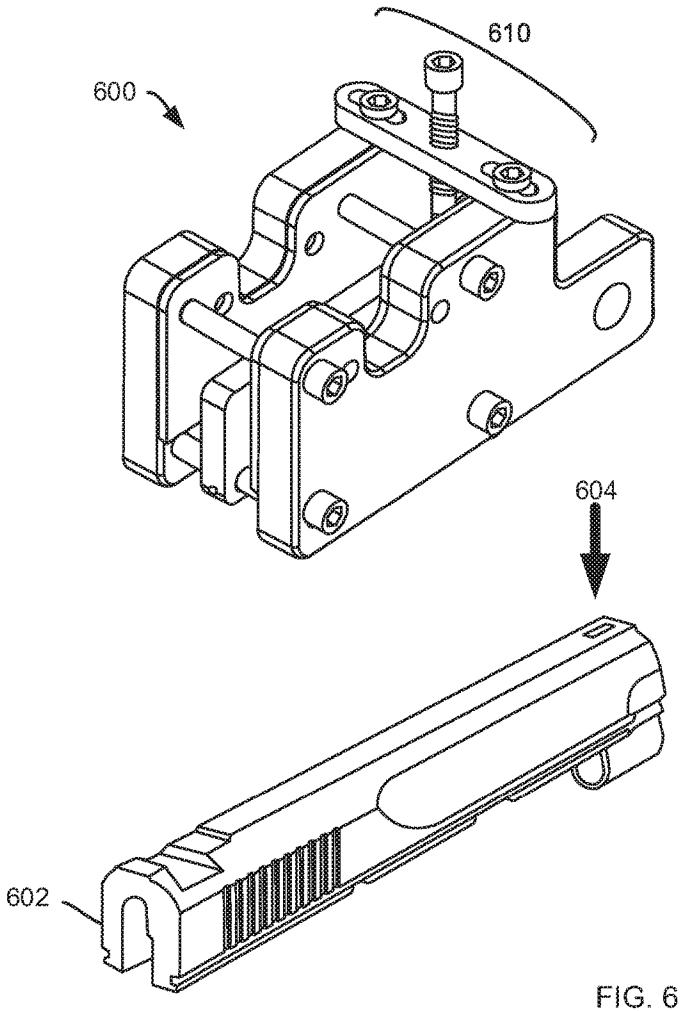
FIG. 6 is an illustrative representation of a firearm sight tool with front staking assembly in accordance with embodiments of the present invention.
Figure 5:
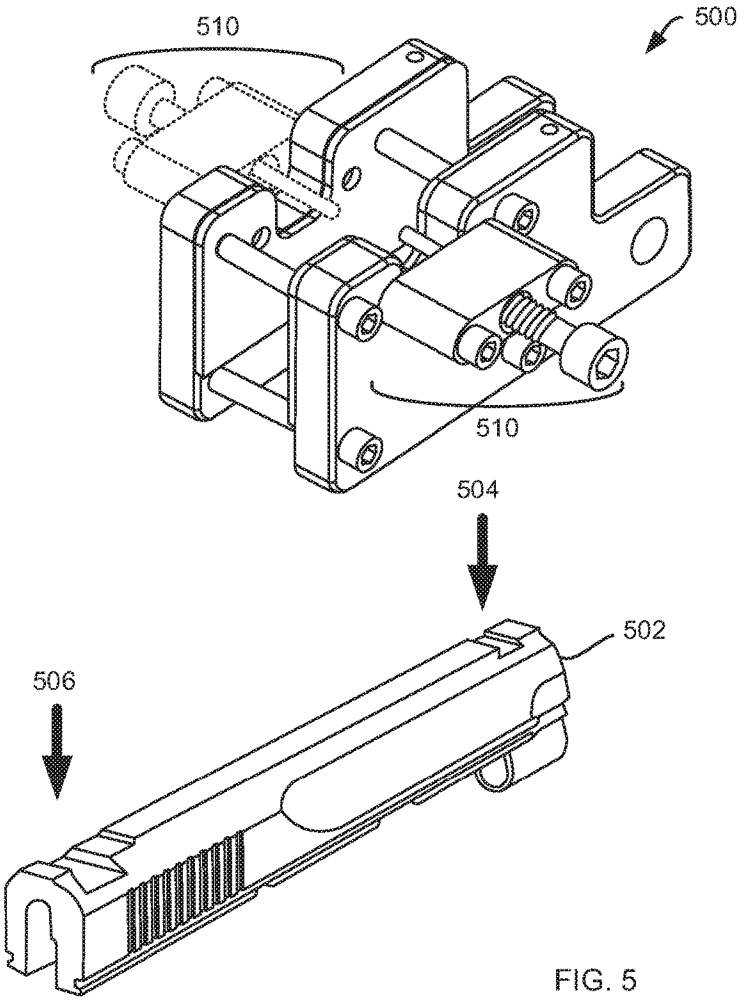
FIG. 5 is an illustrative representation of a firearm sight tool with dovetail sight removal and installation assembly in accordance with embodiments of the present invention.

FIGS. 5 and 6 represent the locations and types of sights that may be operated upon using embodiments provided herein. As such, FIG. 5 is an illustrative representation of firearm sight tool 500 with dovetail sight removal and installation assembly 510 in accordance with embodiments of the present invention. As illustrated, firearm slide 502 may include front dovetail sight location 504 and rear dovetail sight location 506 without limitation. Utilizing embodiments provided herein, a user may remove and install dovetail sights on a firearm slide at the illustrated locations. FIG. 6 is an illustrative representation of firearm sight tool 600 with front staking assembly 610 in accordance with embodiments of the present invention. As illustrated, firearm slide 602 may include front sight location 604. Front sight locations may be slotted or rounded without limitation. Utilizing embodiments provided herein, a user may stake a front sight on a firearm slide at the illustrated location.

Figure 7:
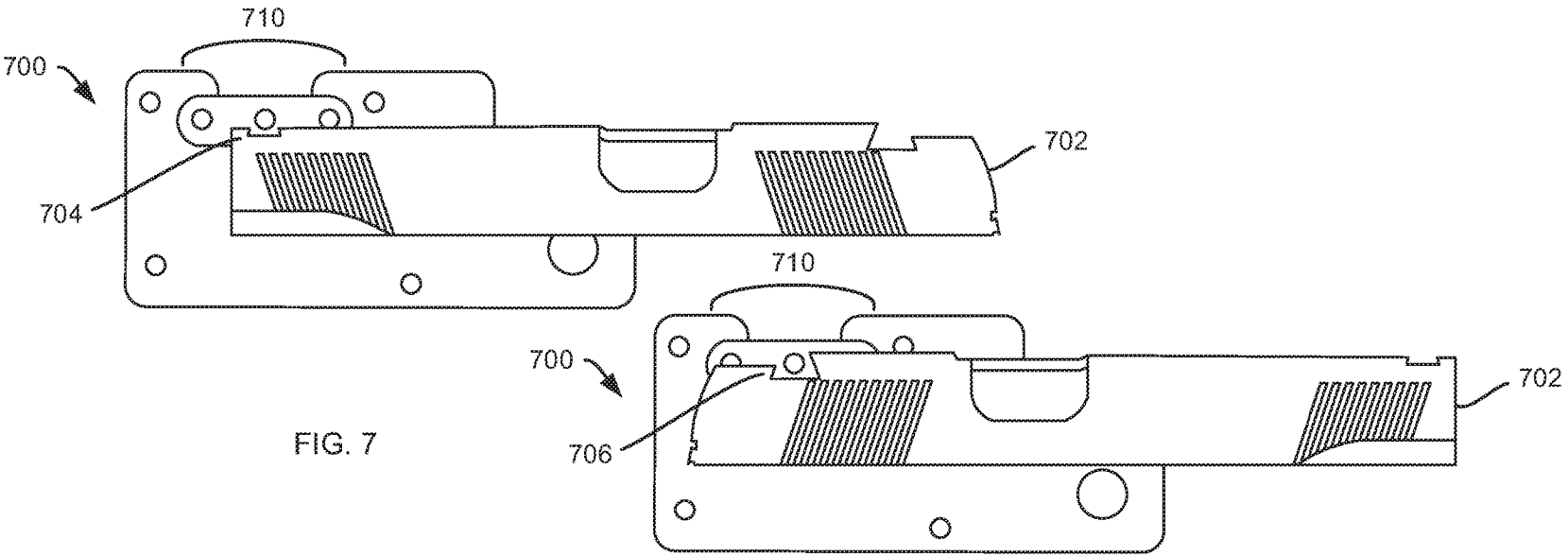
FIG. 7 is an illustrative representation of a firearm sight tool with dovetail sight removal and installation assembly in accordance with embodiments of the present invention.

FIG. 7 is an illustrative representation of firearm sight tool 700 with dovetail sight removal and installation assembly 710 in accordance with embodiments of the present invention. As illustrated, firearm slide 702 may include front dovetail sight location 704 that may include a dovetail sight to be removed or installed. Further illustrated, firearm slide 702 may include rear dovetail sight location 706 that may include a dovetail sight to be removed or installed. The illustration is shown with one of the pair of side plates removed for clarity in understanding embodiments provided herein.

Figure 8:
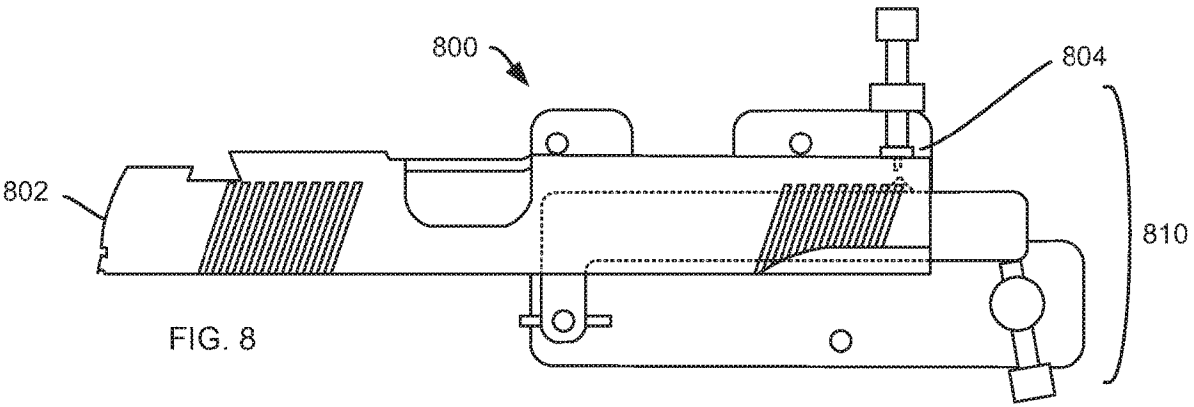
FIG. 8 is an illustrative representation of a firearm sight tool with front staking assembly in accordance with embodiments of the present invention.

FIG. 8 is an illustrative representation of firearm sight tool 800 with front staking assembly 810 in accordance with embodiments of the present invention. As illustrated, firearm slide 802 may include front sight location 804. Front sight locations may be slotted or rounded without limitation. Utilizing embodiments provided herein, a user may stake a front sight on a firearm slide at the illustrated location. As above, the illustration is shown with one of the pair of side plates removed for clarity in understanding embodiments provided herein.

Figure 9:
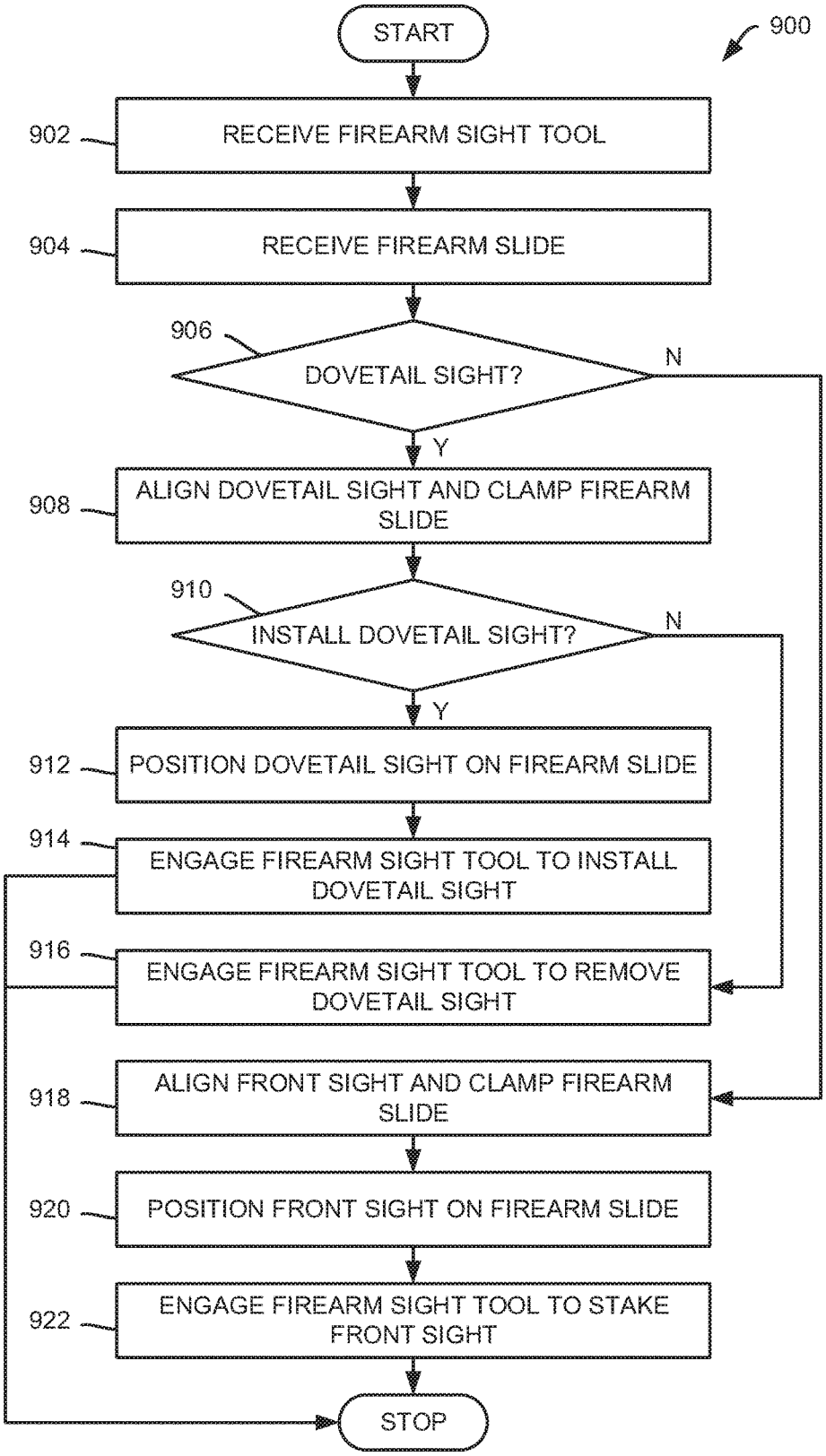
FIG. 9 is an illustrative flowchart of methods for using a firearm sight tool in accordance with embodiments of the present invention.

FIG. 9 is an illustrative flowchart 900 of methods for using a firearm sight tool in accordance with embodiments of the present invention. At a first step 902, the method receives a firearm sight tool as disclosed above. At a next step 904, the method receives a firearm slide. Any number of firearm slides may be utilized with embodiments provided herein. For example, a 1911 slide may be used in combination with embodiments provided herein. At a next step 906 the method determines whether a sight is a dovetail sight. As noted above, firearm sights may include dovetail sights for front sights, for rear sights, or for both front and rear sights. If the method determines at a step 906 that the sight is a dovetail sight, the method continues to a step 908 to align the dovetail sight of the firearm slide with the dovetail sight removal and installation assembly and to clamp the firearm slide in the firearm slide tool. After aligning and clamping the firearm slide at a step 908, the method continues to a step 910 to determine whether to install a dovetail sight. If the method determines at a step 910 to install the dovetail sight, the method continues to a step 912 to position the dovetail sight on the firearm slide and, at a step 914, engages the firearm sight tool using the dovetail sight removal and installation assembly to install the dovetail sight whereupon the method ends. Dovetail firearm sights may be an original equipment part or an aftermarket equipment part without limitation. If the method determines at a step 910 not to install a dovetail sight, that is, to remove a dovetail sight, the method continues to a step 916 to engage the firearm sight tool using the dovetail sight removal and installation assembly to remove the dovetail sight whereupon the method ends.

Returning to a step 906, if the method determines at a step 906 that the sight is not a dovetail sight, the method continues to a step 918 to align the front sight of the firearm slide with the front sight staking assembly and to clamp the firearm slide in the firearm sight tool. At a next step 920, the method positions a front sight on the firearm slide. Adjustments may be made to further alight the front sight with the front sight staking assembly using adjustment screws described above. At a next step 922, the method engages the firearm sight tool using the front sight staking assembly to install the front sight whereupon the method ends. As above, front firearm sights may be an original equipment part or an aftermarket equipment part without limitation.

The terms "certain embodiments", "an embodiment", "embodiment", "embodiments", the embodiment", the embodiments", one or more embodiments", some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean one or more, unless expressly specified otherwise.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A firearm sight tool for removing and installing firearm sights, the firearm sight tool comprising:

a clamping assembly for clamping a firearm slide;

a dovetail sight removal and installation assembly removably coupled with the clamping assembly for removing and installing a dovetail sight for the firearm slide;

a front sight staking assembly removably coupled with the clamping assembly for staking a front sight for the firearm slide;

wherein the front sight staking assembly comprises:

a staking lever removably and pivotally coupled with the clamping assembly along one of a plurality of clamping bolts, the staking lever providing a support disposed along an inner chamber of the firearm slide;

a staking pin disposed along a top surface of the staking lever for staking the front sight;

a staking pivot rod engaged with a front pivot point on the clamping assembly;

a staking bolt threadingly engaged with the staking pivot rod for raising the staking lever;

a front sight stop plate removably coupled with the clamping assembly along a pair of top mounting holes; and a front sight stop threadingly engaged with the front sight stop plate for securing the front sight from moving during a staking operation.

2. The firearm sight tool of claim 1, wherein the clamping assembly further comprises:

a pair of side plates for providing clamping surface, wherein the pair of side plates are substantially parallel with one another;

a plurality of clamping bolts for providing a clamping force for the pair of side plates; and a cutout positioned along a top edge of each of the pair of side plates, the cutout provided for locating the dovetail sight removal and installation assembly such that the dovetail sight removal and installation assembly may be mounted on either of the pair of side plates.

3. The firearm sight tool of claim 2, wherein the dovetail sight removal and installation assembly comprises:

a pusher block;

a plurality of mounting holes disposed along each end of the pusher block, the plurality of mounting holes configured for receiving a plurality of mounting bolts for mechanically and removably coupling the pusher block with either of the pair of side plates proximate with the cutout;

a pusher bolt threadingly engaged with the pusher block;

a pusher bearing disposed along an end of and in mechanical communication with the pusher bolt; and a pusher rod slidingly engaged with the pusher block along an axis of the pusher bolt and in mechanical communication with the pusher bearing.

4. The firearm sight tool of claim 3, wherein the dovetail sight removal and installation assembly further comprises a protective insert for placing between the pusher rod and the dovetail sight such that the dovetail sight is protected from marring when being installed or removed.

5. The firearm sight tool of claim 1, wherein the clamping assembly further comprises:

a pair of side plates for providing clamping surface, wherein the pair of side plates are substantially parallel with one another;

the plurality of clamping bolts for providing a clamping force for the pair of side plates;

the front pivot point disposed along a lower front portion of the pair of side plates for receiving a pivot rod of the front sight staking assembly; and the pair of top mounting holes for removably receiving a sight stop plate of the front sight staking assembly.

6. The firearm sight tool of claim 1, wherein the staking lever further comprises:

an elongated pivot hole for providing staking lever adjustment in a forward and backward direction; a front adjustment screw for adjusting the staking lever in the forward and backward direction; and a rear adjustment screw for adjusting the staking lever in the forward and backward direction.

7. The firearm sight tool of claim 1, wherein the staking lever further comprises:

a pair of staking lever spacers disposed along the one of the plurality of clamping bolts on either side of the staking lever.

8. The firearm sight tool of claim 1, wherein the staking lever further comprises:

a protective disc disposed along a contact surface of the front sight stop to provide a non-marring surface for the front sight during the staking operation.

9. The firearm sight tool of claim 1, wherein the clamping assembly further comprises:

a pair of protective layers disposed along an inner surface of the pair of side plates to provide a non-marring surface when clamping a firearm slide.

10. The firearm sight tool of claim 1, wherein the clamping assembly further comprises:

a plurality of protective sleeves disposed along the plurality of clamping bolts to provide a protective surface for the plurality of clamping bolts.

11. A method for removing and installing firearm sights comprising:

receiving a firearm slide;

providing a firearm sight tool, the firearm sight tool comprising, a clamping assembly for clamping a firearm slide, a dovetail sight removal and installation assembly removably coupled with the clamping assembly for removing and installing a dovetail sight for the firearm slide, and a front sight staking assembly removably coupled with the clamping assembly for staking a front sight for the firearm slide;

clamping the firearm slide in the firearm sight tool;

installing a sight on the firearm slide; and wherein the sight is a front sight, and wherein the method further comprises:

aligning the front sight with the front sight staking assembly, the front sight staking assembly comprising, a staking lever removably and pivotally coupled with the clamping assembly along one of a plurality of clamping bolts, the staking lever providing a support disposed along an inner chamber of the firearm slide, a staking pin disposed along a top surface of the staking lever for staking the front sight, a staking pivot rod engaged with a front pivot point on the clamping assembly, a staking bolt threadingly engaged with the staking pivot rod for raising the staking lever, a front sight stop plate removably coupled with the clamping assembly along a pair of top mounting holes, and a front sight stop threadingly engaged with the front sight stop plate for securing the front sight from moving during a staking operation; positioning the front sight on the firearm slide; and engaging the firearm sight tool to stake the front sight.

12. The method of claim 11, wherein the clamping assembly further comprises:

a pair of side plates for providing clamping surface, wherein the pair of side plates are substantially parallel with one another, a plurality of clamping bolts for providing a clamping force for the pair of side plates, and a cutout positioned along a top edge of each of the pair of side plates, the cutout provided for locating the dovetail sight removal and installation assembly such that the dovetail sight removal and installation assembly may be mounted on either of the pair of side plates, wherein the sight is a dovetail sight, and wherein the method further comprises:

aligning the dovetail sight with the dovetail sight removal and installation assembly, the dovetail sight removal and installation assembly comprising, a pusher block, a plurality of mounting holes disposed along each end of the pusher block, the plurality of mounting holes configured for receiving a plurality of mounting bolts for mechanically and removably coupling the pusher block with either of the pair of side plates proximate with the cutout, a pusher bolt threadingly engaged with the pusher block, a pusher bearing disposed along an end of and in mechanical communication with the pusher bolt, and a pusher rod slidingly engaged with the pusher block along an axis of the pusher bolt and in mechanical communication with the pusher bearing;

positioning the dovetail sight on the firearm slide; and engaging the firearm sight tool to install the dovetail sight.

13. The method of claim 12, wherein the dovetail sight is a rear dovetail sight or a front dovetail sight.

14. The method of claim 12, further comprising:

engaging the firearm sight tool to remove the dovetail sight.

15. The method of claim 11, wherein the clamping assembly further comprises:

a pair of side plates for providing clamping surface, wherein the pair of side plates are substantially parallel with one another, the plurality of clamping bolts for providing a clamping force for the pair of side plates, the front pivot point disposed along a lower front portion of the pair of side plates for receiving a pivot rod of the front sight staking assembly, and the pair of top mounting holes for removably receiving a sight stop plate of the front sight staking assembly.

* * * * *